United States Patent [19]

Buck et al.

[11] Patent Number: 4,574,597

[45] Date of Patent: Mar. 11, 1986

[54] YARN FEEDING APPARATUS, PARTICULARLY FOR KNITTING MACHINES

[75] Inventors: Alfred Buck, Rottenburg; Erich Roser, Bermatingen, both of Fed. Rep. of Germany

[73] Assignee: Memminger GmbH, Freudenstadt, Fed. Rep. of Germany

[21] Appl. No.: 632,403

[22] Filed: Jul. 19, 1984

[30] Foreign Application Priority Data

Jul. 20, 1983 [DE] Fed. Rep. of Germany ..... 3326099

[51] Int. Cl.[4] ..... D04B 15/48

[52] U.S. Cl. ..... 66/125 R; 242/47.01

[58] Field of Search ..... 66/125 R, 132 R, 132 T; 139/452; 242/47.01

[56] References Cited

U.S. PATENT DOCUMENTS

| | | | |
|---|---|---|---|
| 2,728,446 | 12/1955 | Bakker | 242/47.01 |
| 3,672,590 | 6/1972 | Rosen | 66/132 R X |
| 3,759,300 | 9/1973 | Pfarrwaller | 242/47.01 X |
| 3,957,217 | 5/1976 | Clemens | 242/47.01 |
| 4,138,866 | 2/1979 | Fecker et al. | 66/132 R |
| 4,180,215 | 12/1979 | Nürk | 242/47.01 |

FOREIGN PATENT DOCUMENTS

| | | |
|---|---|---|
| 1966159 | 11/1971 | Fed. Rep. of Germany . |
| 1760738 | 1/1972 | Fed. Rep. of Germany . |
| 2225918 | 10/1973 | Fed. Rep. of Germany . |
| 2613273 | 12/1976 | Fed. Rep. of Germany . |
| 2608590 | 2/1980 | Fed. Rep. of Germany . |
| 2743749 | 4/1980 | Fed. Rep. of Germany . |

*Primary Examiner*—Wm. Carter Reynolds

*Attorney, Agent, or Firm*—Frishauf, Holtz, Goodman & Woodward

[57] ABSTRACT

A yarn feeding or supply apparatus for textile machines, particularly knitting machines, has a rotatable storage drum supported on a holder, which can be coupled to a drive source setting it into rotation and having yarn guide elements for directing yarn to and from the drum associated with it.

In order to assure satisfactory formation of windings of storage yarn on the storage drum even with yarns which may be difficult to handle, the arrangement is such that the yarn supply guide element directing the yarn onto a first conical circumferential surface, acting as the yarn run-on surface, is disposed at least at the height of this surface; that the storage drum has an inwardly receding conical yarn support surface adjoining a second conical circumferential surface in the axial direction, the cone angle of the yarn support surface being substantially smaller than that of the second conical surface, an annular surface extending essentially at right angles to the two conical surfaces being disposed between these two conical surfaces, and the axial length of the yarn support surface being appropriate for receiving an intermediate group of yarn loops comprising a plurality of adjacent yarn windings; and that the conical yarn support surface merges with an essentially cylindrical circumferential surface of the storage drum accepting the storage loops of yarn.

19 Claims, 6 Drawing Figures

YARN FEEDING APPARATUS, PARTICULARLY FOR KNITTING MACHINES

Reference to related disclosures:

U.S. Pat. No. 2,613,273, to which German Patent Disclosure Document DE-OS No. 26 13 273 corresponds;

U.S. Pat. No. 4,138,866, to which German Patent No. 26 08 590 corresponds;

U.S. Pat. No. 4,180,215, to which German Published Application DE-AS No. 27 43 749 corresponds.

The present invention relates to a yarn feeder, and more particularly to a yarn feeding apparatus for used with textile machinery, especially knitting machines and particularly circular knitting machines, in which yarn is positively supplied to a rotatably driven drum on which a plurality of winding loops can be stored to form storage windings thereon.

BACKGROUND

Various forms of embodiment of yarn supply apparatus are known in the art for feeding yarn in a slip-free or positive manner, having a yarn storage or supply drum driven by a drive source such as a perforated belt. Supply windings or loops of yarn, comprising a plurality of windings located beside one another, are retained on the drum. In order to assure a neatly wound yarn supply in which storage loops are located beside one another in an orderly pattern, the storage loops, from one end of which yarn is drawn off continuously, must be axially displaced on the storage drum toward the yarn run-off side at the same rate as yarn is delivered to the storage loops on the run-on or supply side. In storage drums which have a cylindrical circumferential surface, the drums require their own feed apparatuses (such as that disclosed in U.S. Pat. No. 4,138,866, to which German Patent No. 26 08 590, corresponds). Although these feed apparatuses do assure a satisfactory axial advancement or feed of the storage loops for all types of yarns and threads in practical use, still they represent an additional expense, aside from the fact that they also require a certain amount of maintenance.

Yarn supply or feed apparatuses have therefore become known in which by means of a particular shaping of the profile of the storage drum, an automatic axial feed of the storage loops on the drum is attained, so that a separate, additional feed device cooperating with the drum or with the windings located on it can be dispensed with. In a storage drum of this type (U.S. Pat. No. 2,613,273, to which German Patent Disclosure Document DE-OS No. 26 13 273 corresponds), a yarn run-on or supply zone which curves continuously inward is provided, on which the yarn runs on at a tangent and which gradually merges into a slightly conical transitional zone, which in turn joins a cylindrical circumferential surface of the drum. This embodiment of the storage drum does result in an axial feeding or advancement of the storage loops; however, when it is used for various yarns it cannot be precluded that with some types of yarn the windings of the storage loops will tangle or drop off, impairing the run-off of the yarn, thereby causing nonuniform yarn supply and yarn breakage.

In a yarn storage and supply apparatus having a storage drum of basically similar embodiment (U.S. Pat. No. 4,180,215, to which German Published Application DE-AS No. 27 43 749 corresponds), which has on its circumference a support surface, receding in an inward curve from the yarn delivery location, for a plurality of yarn windings located beside one another, the arrangement was therefore chosen such that the support surface of the storage drum extends with a continuous curvature from the initial surface, which recedes inward, to a final zone, which widens outward toward the yarn draw-off side and at the end of which zone the diameter of the storage drum is larger than at its end on the yarn run-in side. However, because of the continuously curved shape of the support surface, this storage drum operates with a certain slip between the yarn and the storage drum. In man-made monofilamentary yarns, for instance, this causes a certain wearing of the support surface, with the result that the circumferential surface of the storage drum must be provided with an absolutely smooth and wear-resistant surface, which in turn makes the manufacture of the storage drum substantially more expensive.

THE INVENTION

It is an object to provide a positive yarn feeding apparatus in which specific axial fed arrangements for the storage loops are not necessary and which, nevertheless, insures that yarn is fed positively, without overlap, although the characteristics and compositions of the yarns may be such that they are ordinarily difficult to handle. Further, the apparatus should be simple to manufacture, so that it can be provided to the industry at low cost.

Briefly, the storage drum is formed with a plurality of surfaces which, generally, are conical and cylindrical, and which are arranged in a specific manner on the drum. The yarn is supplied to a first conical circumferential surface by a yarn guide eye located preferably at the same level as the first conical circumferential surface. Downwardly, and in the axial direction, a second conical circumferential surface joins the first one. The second conical circumferential surface may be very steep, almost radially inwardly flat, which is hollowed by an inwardly slightly tapering conical circumferential yarn receiving surface, having a cone angle substantially less than the cone angle of the second, almost flat conical circumferential surface. The axial length of the slightly conical surface is long enough to be suitable for accepting a few adjacently positioned winding loops. This slightly conical surface then merges with the circumferential surface which is essentially cylindrical—although it may be very slightly conical—and which carries the major portion of the storage windings.

The arrangement with the plurality of conical surfaces has the advantage that the apparatus can be easily made, for instance on automatic screw machines, or by axial assembly of suitably circumferentially shaped discs. Additionally, the yarn is positively fed, and automatic axial feed of the yarn from the run-on first conical surface to the cylindrical surface is insured while preventing tangling, or drop-off, of yarn loops.

The supplied or run-on yarn is guided in particular via the lower portion, adjoining the annular surface, of the first conical circumferential surface onto the conical yarn support surface, extending in the form of a chord in the region of the second conical circumferential surface, so that it does not touch the annular surface. As a result, the yarn is laid in an orderly manner upon the conical yarn support surface in windings located exactly beside one another and forms a positive intermediate group of windings on this surface, which because of the small cone angle included between the conical yarn support surface and the axis of the storage drum produces practically no frictional stress on the surface of the storage drum in the vicinity of the yarn bearing surface. The windings of the intermediate group slide in succession on the adjoining cylindrical circumferential surface which carries the actual storage loops where the majority of the yarn is stored. The windings of this set of storage loops located on the cylindrical circumferential surface are relaxed somewhat as compared with those of the intermediate group of windings formed on the conical yarn support surface, with the result that the storage loops on the cylindrical circumferential surface can be displaced downward automatically, without tangling or drop-off of the windings.

The cone angle of the first conical circumferential surface is as a rule smaller than that of the second conical circumferential surface; it has been found suitable for the second conical circumferential surface to include an angle of approximately 60° to 70° with the axis of the storage drum. It has furthermore proved advantageous for the first conical circumferential surface to join the annular surface via an annular, rounded surface zone. This zone in fact guides the yarn onto the conical yarn support surface and therefore has a yarn-guiding function. The conical yarn support surface must have a conicity such that the intermediate group of windings formed on it can be displaced in an orderly manner without tangling or drop-off of the windings.

It has been demonstrated in practice that excellent operating conditions are attained particularly when the conical yarn support surface includes an angle of from 2° to 10° with the storage drum axis. The yarn support surface may merge directly with the adjoining cylindrical circumferential surface, and the annular line dividing the two surfaces may be a well-defined edge or a rounded edge. Good results were also attained, however, when the conical yarn support surface was joined to the cylindrical circumferential surface of small diameter via a small annular shoulder. The change in diameter in the vicinity of the annular shoulder makes it possible to provide an additional relaxation of the yarn windings as they leave the conical yarn support surface, or in other words at the transition from the intermediate group of windings to the actual storage windings themselves on the cylindrical circumferential surface. This annular shoulder may be embodied by a plane or rounded annular surface or, advantageously, by a conical surface.

For the run-off of the yarn from the cylindrical circumferential surface, it has proved to be advantageous if the cylindrical circumferential surface is joined by a rim, or ridge, or bead disposed extending about the end of the storage drum. On the other hand, the conditions of yarn delivery can be adpated to a certain extent to the characteristics of a particular yarn to be supplied by embodying the yarn supply guide element such that it is adjustable in height, and it is on occasion suitable for this element to be directed toward the storage drum axis.

At least the first conical circumferential surface or the cylindrical circumferential surface, or both, may be embodied with grooves or slots extending in the axial direction, so that the yarn rests only on the rib-like portions of the surface located between the grooves or slots.

Since the storage drum is provided only with surfaces of a relatively simple geometrical shape, the manufacture of the storage drum is much less complicated than in the case of structure in which large areas of the circumferential surface must have an accurately predetermined continuous curvature. It is therefore possible for the storage drums to be embodied in one piece or several pieces, and in the latter case the cylindrical circumferential surface may also be embodied on a ring the surface of which may optionally be hardened or tempered. The structure becomes very simple if the ring is formed of a strip of corrugated sheet metal the corrugations of which are disposed extending in the axial direction. The yarn run-on surface may also be embodied by a strip of corrugated sheet metal, as may the cylindrical circumferential surface and the yarn support surface. A ring or strip of corrugated sheet metal such as this is particularly inexpensive to make; at the same it, it assures that the yarn windings resting on the various surfaces does so only on the protruding corrugations.

DRAWINGS

FIG. 1 is a side view of a yarn feeding apparatus according to the invention;

FIG. 2, on a different scale, shows the storage drum of the yarn feeding apparatus of FIG. 1, in a fragmentary axial section seen from the side;

FIG. 2*a* is a fragmentary detail view of a portion of the structure of FIG. 2, illustrating a modified embodiment;

FIG. 2*b* is a fragmentary detail view of another portion of the structure of FIG. 2 and illustrating another modified embodiment;

FIG. 3 shows the storage drum of FIG. 2, illustrating the course of yarn travel; and FIG. 4 shows the apparatus of FIG. 3 in a view taken along the line IV—IV of FIG. 3.

DETAILED DESCRIPTION

Figure 1:
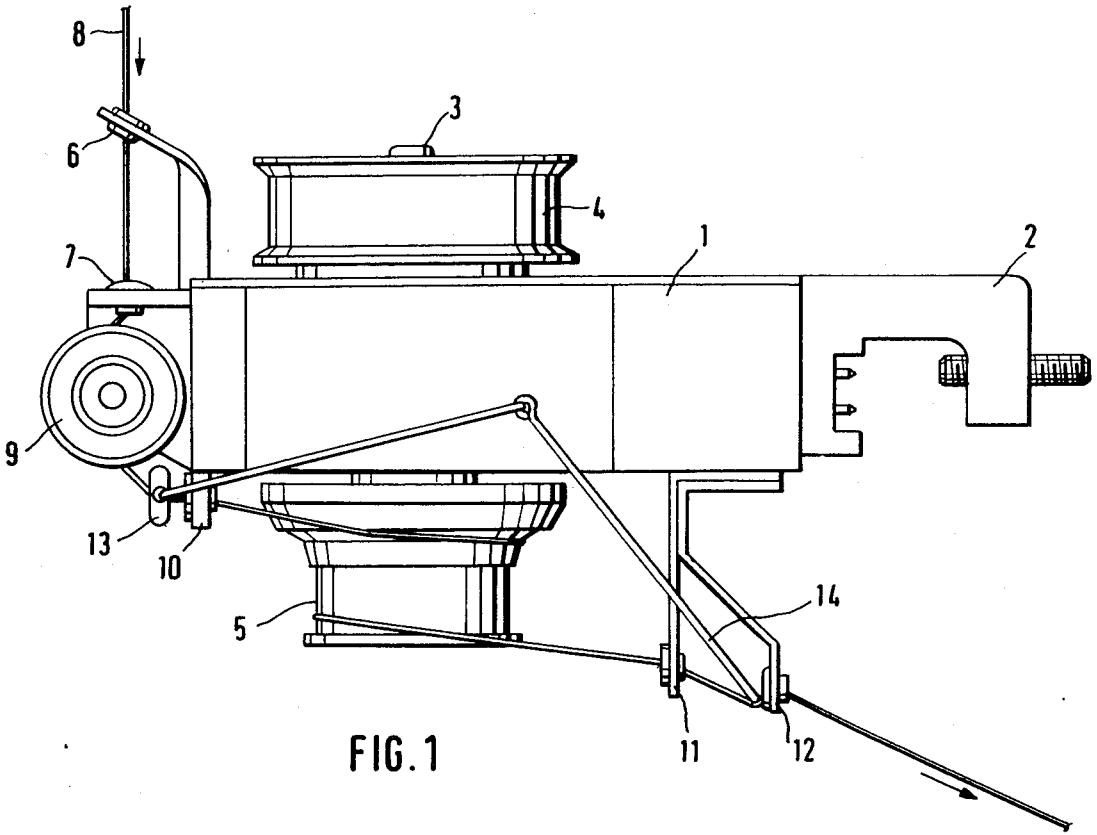

The yarn feeding or supply apparatus shown in FIG. 1 has a holder 1 embodied in the manner of a housing, which can be secured by means of a clamping device 2 to a holder or support structure of the associated textile machine, for instance to a holder ring of a circular knitting machine. A shaft 3 is rotatably supported in the holder 1 and a drive pulley 4 is secured on the shaft above the holder 1 in a rotationally fixed manner. On the underside of the holder, the shaft 3 carries a storage drum 5, which is likewise secured to the shaft in a rotationally fixed manner. Thus the storage drum 5 can be coupled to a drive source, not otherwise shown, and set to rotating via the drive pulley 4.

Two yarn guide eyes 6, 7 are disposed on the holder 1 to the side of the storage drum 5, guiding the yarn 8 arriving from a spool, not otherwise shown, via a yarn brake 9 to a yarn run-on or supply guide eye 10, from whence the yarn is delivered to the storage drum. This process will be described in further detail below. The yarn running off the storage drum 5 passes through a yarn draw-off guide element 11, which is secured to the holder 1 and is followed at a distance by a further yarn guide eye 12, which is likewise secured to the holder 1. The supplied or run-on yarn is monitored for breakage by a yarn run-on feeler 13, while the yarn running off the drum is monitored by a yarn run-off feeler 14. The two yarn break monitor feelers 13, 14 scan or feel the yarn in some known manner and actuate shutoff devices in the interior of the housing-like holder 1 as soon as the yarn tension decreases or becomes completely absent.

Figure 2:
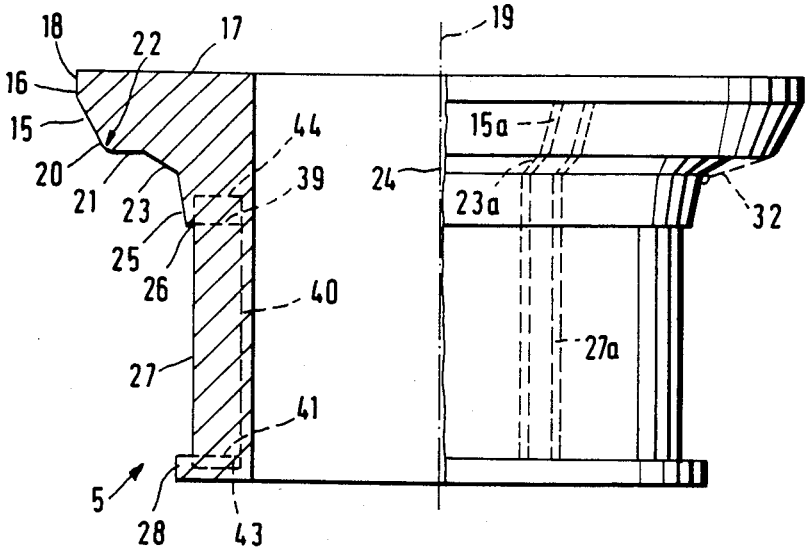

The structure of the storage drum 5 is shown in detail in FIG. 2. This particular storage drum 5 is embodied in one piece; in principle, however, the storage drum may also be embodied in several parts.

The storage drum 5, embodied as a rotational body, has a first conical circumferential surface 15 with a straight generatrix, the largest diameter of which—at 16—is located in the vicinity of the free end face 17 of the storage drum 5 and is separated from this free end face 17 by a cylindrical surface 18 of a short axial length. The first circumferential surface 15, which forms a yarn run-on surface, includes an angle of approximately 30° with the axis 19 of the storage drum. In the vicinity of its smallest diameter—at 20—the first conical circumferential surface 15 is intersected by an annular surface 21, which extends substantially at right angles to the axis 19 of the storage drum. The first conical circumferential surface 15 joins the annular surface 21 via a rounded surface zone, the radius of which is indicated at 22. The radius 22 is typically on the order of magnitude of 0.5 mm.

Receding from surface 15 is an annular surface 21 which is joined by a second conical circumferential surface 23 which recedes further inwardly in the axial direction and likewise has a straight generatrix, and which forms an angle of approximately 60° to 70°, preferably 68°, with the storage drum axis 19. The axial projection 24 of surface 23, i.e. the axial extent along the storage drum axis 19 is relatively short (for instance, approximately 0.6 mm).

The second conical circumferential surface 23 is followed in the axial direction of the storage drum 5 by a conical yarn support surface 25 having a straight generatrix, the axial length of this surface 25 being dimensioned such that it suffices for receiving an intermediate group of yarn loops or windings encompassing a plurality of windings located beside one another. The yarn support surface 25 includes an angle of between 2° and 10° with the storage drum axis 19. This surface 25 is joined, via an annular shoulder 26, by a cylindrical circumferential surface 27, which has a relatively long axial length and serves to receive the actual storage loops of yarn. The cylindrical circumferential surface 27, finally, terminates at a radially protruding annular rim, or ridge, or bead 28 disposed on the end of the storage drum 5. The cross-sectional shape of this bead 28 may also be rounded.

The annular shoulder 26 has only a short radial length, which is shown on an exaggerated scale in FIG. 2 for the sake of clarity. Its radial length typically amounts to approximately 0.05 mm. Other forms of embodiment are also possible; the shoulder may be formed by a conical surface 26' (FIG. 2*a*); or the annular shoulder 26 may be omitted and the conical yarn support surface 25 thus merges directly with the cylindrical circumferential surface 27, the transition between the two surfaces being rounded or else embodied by an annular edge.

OPERATION

Figure 3:
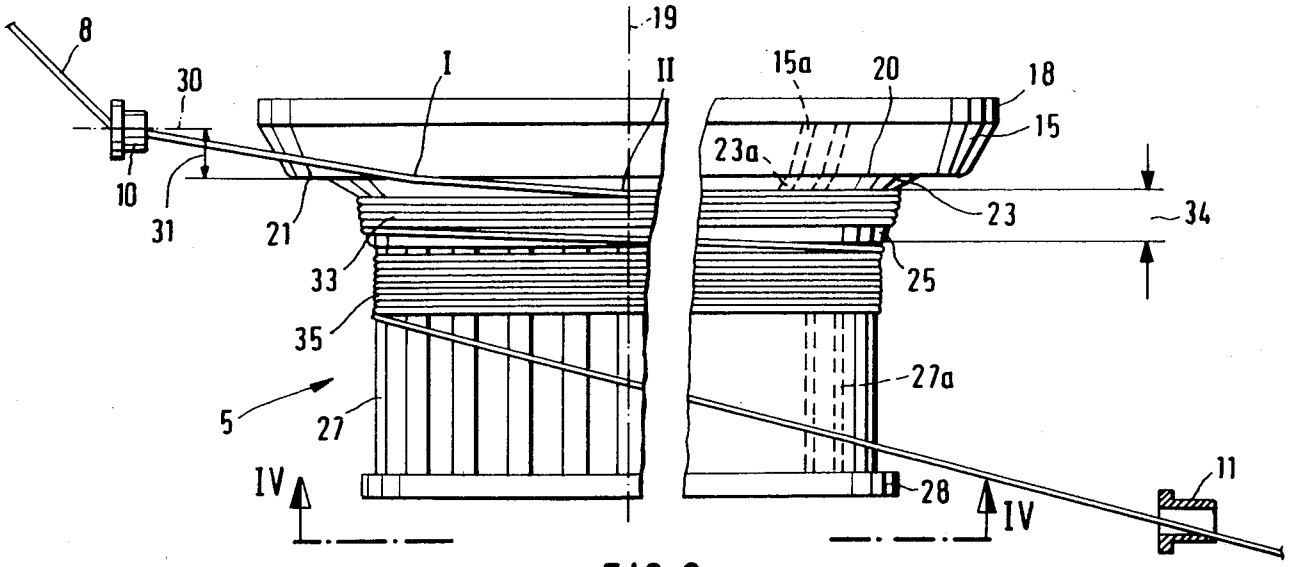
Figure 4:
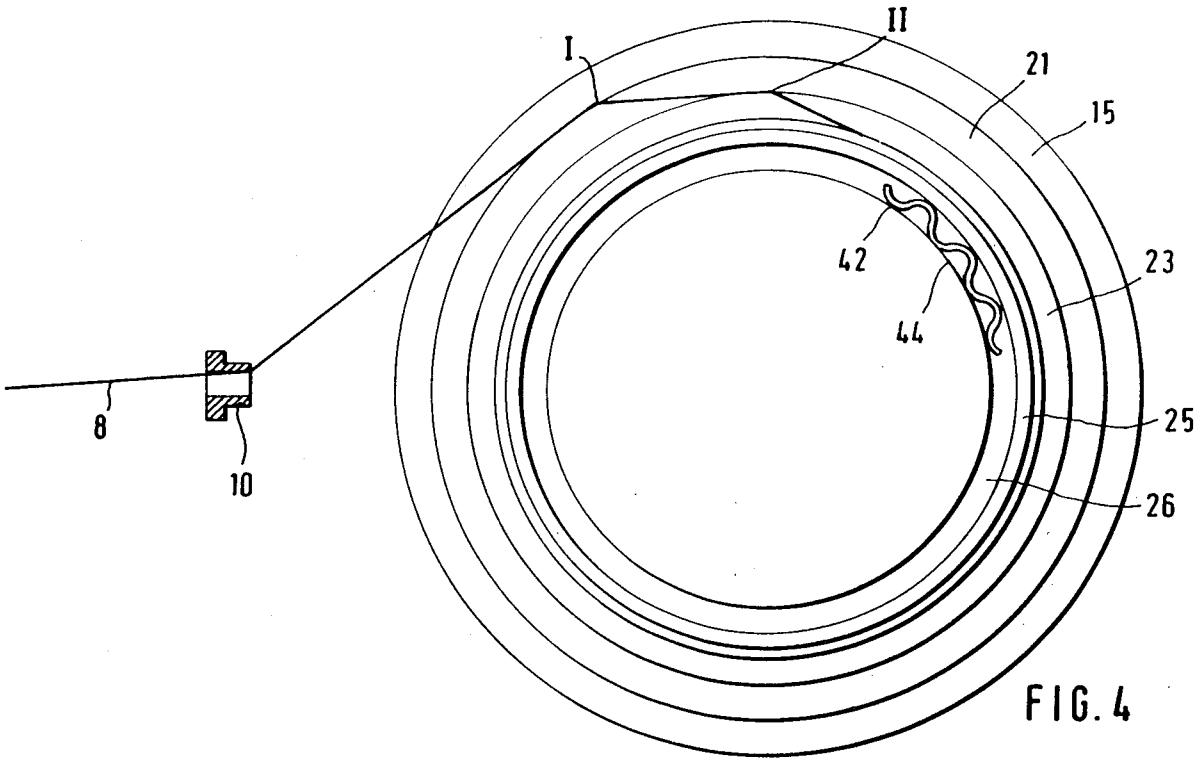

The function of the yarn feeding apparatus and storage drum 5 as described above, as well as the course of yarn travel, is shown particularly in FIGS. 3 and 4:

The yarn guide eye 10 is disposed spaced apart laterally from the storage drum 5 such that it is directed toward the storage drum axis 19 (FIG. 4). It is supported on the holder 1 such that it can be adjusted in height in such a way that it is at least at the height, or level, of the first conical circumferential surface 15; in other words, its axis shown at 30 in FIG. 3 extends spaced apart by a distance 31 from the annular surface 21 below it. The distance 31 may also be dimensioned such that the axis 30 extends above the end face 17 of the storage drum 5.

The yarn supply guide 10 guides the yarn 8 approximately at a tangent onto the first conical circumferential surface 15 serving as the yarn run-on surface, the yarn being drawn over the rounded surface region at 20 at the transition to the annular surface 21, so that there is a bend, indicated at I, in the course of the yarn in this transitional zone leading to the annular surface 21.

From the rounded zone at 20, the yarn 8 extends in the form of a chord to the transitional zone between the second conical circumferential surface 23 and the conical yarn support surface 25, resulting in a second bend, at II, in the course of the yarn. This chord-like course of the yarn is indicated by dashed lines at 32 in FIG. 2, showing that the yarn 8 does not touch the annular surface 21 and comes into contact with the second conical circumferential surface 23 only in the "corner" leading to the yarn support surface 25, in order to place the yarn upon the yarn support surface 25 in the form of continuously forming windings, or loops, beside one another. The axial feeding of the most recently formed yarn loop is promoted by the fact that the tensed chord 32 of yarn arrives reliably at II in the "corner", thereby creating a wedge-shaped gap between the most recently formed yarn loop and the second conical circumferential surface 23, into which gap the yarn 8 can enter.

An intermediate group of windings, indicated at 33 in FIG. 3, thus forms on the yarn support surface 25, comprising an appropriate number of yarn windings or loops located one beside the other, which are coupled in a frictionally engaged manner with the yarn support surface 25, and hence the storage drum 5, thereby effecting positive, or slip-free, yarn supply. The axial length of the conical yarn support surface 25 indicated at 34 in FIG. 3, when projected upon the storage drum axis 19, amounts to at least 1.5 mm and is typically in the range from 1.5 to 5 mm.

The intermediate group of yarn loops 33 is moved continuously downward on the conical yarn support surface 25 by the new yarn loops being formed continuously above it, the new loops being pressed by the second conical circumferential surface against the loop or winding immediately preceding them. The lowermost loops arrive in succession, via the annular shoulder 26, upon the cylindrical circumferential surface 27, on which they form the actual set of yarn storage loops 35, which comprises a plurality of windings from the underside of which the yarn 8 is drawn obliquely downward at a tangent via the yarn draw-off guide element 11.

At the transition from the intermediate group of windings 33, located on the conical yarn support surface 25, to the storage loops 35 located on the cylindrical circumferential surface 27, the individual yarn loops are relaxed somewhat, the extent of this relaxation being determined by the radial length of the annular shoulder 26 or the cone angle of the yarn support surface 25. The required axial yarn feeding can therefore take place in a simple manner in the vicinity of the storage loops 35, without there being a danger that the individual loops of yarn will tangle or drop off.

The storage drum 5 may be embodied in one piece, and in the vicinity of the first circumferential surface 15 and/or the circumferential surface 27 as well as of the yarn support surface 25 and/or the second conical circumferential surface 23, it may be embodied with axially extending grooves or slots, as is suggested by the dashed lines at 15*a* and 27*a*, 25*a* and 23*a* in FIGS. 2, 3. It is thereby attained that the yarn rests only on rib-like areas of the surface, which may be suitable under some circumstances for the purpose of yarn feeding.

Aside from this, it is also possible for the storage drum 5 to have a multiple-part structure, for instance in which the surfaces 18, 15, 21, 23 and 25 are embodied on one common disc 39 (FIG. 2), which is joined to a ring 40 bearing the circumferential surface 27, and a second end disc forming the ridge or bead 28, the plane of separation of which is indicated at 41 in FIG. 2, may be optionally mounted upon the ring 40.

Instead of the ring 40, individual, spaced-apart, parallel rods or ribs may be provided, in which case the cylindrical circumferential surface 27 forms the envelope of a cage of rods.

A particularly simple construction is attained if the ring 40 is embodied by a finite or endless strip of corrugated sheet metal bent into an annular shape, the corrugations of which extend in the axial direction, as shown at 42 in FIG. 4. The annular strip of corrugated sheet metal 42 is merely inserted at the end into corresponding annular grooves 43, 44 of the disc 39, or of the disc embodying the run-off bead 28. It is also possible for the surfaces 15, 18 23 and 25—either individually or together—to be embodied by correspondingly annularly curved strips of corrugated sheet metal.

Figure 2B:
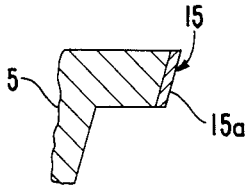
Figure 2A:
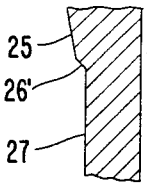

FIG. 2*b* shows, by way of illustration, strip 15*a* of corrugated sheet metal on drum 5, defining the surface 15.

Finally, the entire storage drum 5 may also be produced as a deep-drawn part or by extrusion methods, for which the shape of the storage drum 5 that widens in funnel-like fashion toward the top is suitable.

In order to convey some idea of the order of magnitude of the actual size of the storage drum 5, it is noted that the largest diameter of the second conical circumferential surface 23 is approximately in the range from 51 to 54 mm, while the projection 24 of this circumferential surface amounts to 0.6 mm, as already noted, and the projection 34 of the conical yarn support surface 25 is at least 1.5 mm long and in the range of up to 5 mm long.

We claim:

1. Yarn feeding apparatus, particularly for knitting machines, having:

a driven storage drum (5) having a plurality of axially adjacent yarn storage or yarn loop accepting surfaces;

a yarn supply guide element (10) and a yarn draw-off guide element (11) to guide yarn to and from the drum, comprising a first circumferential conical surface (15), the yarn supply guide element (10) being oriented to supply yarn (8) at said first surface and located at least at the axial level, or height, of said first conical surface;

a second conical surface (23) essentially adjoining the first conical surface, extending radially inwardly, and having a cone angle substantially greater than that of the first conical surface;

a third conical surface (25) essentially adjoining the second conical surface, and having a cone angle which is substantially smaller than the cone angle of the second conical surface (23), and an axial length dimensioned to receive a few adjacently located yarn loops thereon, whereby the third conical surface will form a yarn support surface which tapers radially inwardly to form an intermediate yarn loop storage zone (33) on the drum;

and an essentially cylindrical circumferential surface (27) essentially adjoining the third conical surface and having an axial length dimensioned to receive the yarn storage loops (35) to be wound on the yarn storage drum (5), the yarn draw-off guide element (11) being positioned to draw off yarn stored on the storage drum on the essentially cylindrical circumferential surface (27) for supply of yarn to a feed of a textile machine.

2. Yarn feeding apparatus according to claim 1, wherein the cone angle of the first conical surface (15) is smaller than that of the second conical surface (23).

3. Yarn feeding apparatus according to claim 1, wherein the second conical surface (23) includes an angle of approximately 60°–70°, preferably 68°, with the storage drum axis (19).

4. Yarn feeding apparatus according to claim 1, wherein the first conical surface (15) adjoins an annular surface (21) via an annular, rounded surface zone (20).

5. Yarn feeding apparatus according to claim 1, wherein the conical yarn support surface (25) includes an angle of from 2° to 10° with the storage drum axis (19).

6. Yarn feeding apparatus according to claim 5, wherein the length of the projection of the conical yarn support surface (25) upon the storage drum axis (19) amounts to at least 1.5 mm.

7. Yarn feeding apparatus according to claim 1, wherein the cylindrical circumferential surface (27) is adjoined by a ridge or bead (28) disposed about the storage drum (5) at its end.

8. Yarn feeding apparatus according to claim 1, wherein the conical yarn support surface (25) adjoins the cylindrical circumferential surface (27) of small diameter via a small annular shoulder (26).

9. Yarn feeding apparatus according to claim 8, wherein the annular shoulder is formed by a conical surface (26').

10. Yarn feeding apparatus according to claim 1, wherein the yarn supply guide element (10) is directed towards the storage drum axis (19).

11. Yarn feeding apparatus according to claim 1, wherein the yarn supply guide element (10) is embodied such that it is adjustable in height.

12. Yarn feeding apparatus according to claim 1, wherein at least one of (a) the first conical circumferential surface (15); (b) the cylindrical circumferential surface (27)

is formed with grooves or slots (15*a*, 27*a*) extending in the axial direction.

13. Yarn feeding apparatus according to claim 1, wherein the storage drum (5) is a unitary, one-piece element.

14. Yarn feeding apparatus according to claim 13, wherein the storage drum (5) is formed as a unitary, one-piece, deep-drawn or extruded element.

15. Yarn feeding apparatus according to claim 1, wherein the storage drum (5) is comprises a plurality of parts and the cylindrical circumferential surface (27) is formed on a ring (40).

16. Yarn feeding apparatus according to claim 15, wherein the ring (40) is formed from a strip of corrugated sheet metal (42), the corrugations of which extend in axial direction.

17. Yarn feeding apparatus according to claim 1, wherein the first conical surface (15) forms a yarn run-on surface, formed as a strip of corrugated sheet metal.

18. Yarn feeding apparatus according to claim 15, wherein the surface of the ring (40) is hardened.

19. Yarn feeding apparatus according to claim 1, wherein an annular surface (21) is provided, positioned between the first conical surface (15) and the second conical surface (23);

the smallest diameter of the first conical surface (15) intersecting the annular surface, the annular surface extending essentially at right angles to the axis (19) of the storage drum (5), the annular surface merging with the second conical surface (23) at the largest diameter of said second conical surface.

* * * * *

UNITED STATES PATENT AND TRADEMARK OFFICE

CERTIFICATE OF CORRECTION

PATENT NO. : 4,574,597

DATED : MARCH 11, 1986

INVENTOR(S) : Alfred BUCK et al

It is certified that error appears in the above-identified patent and that said Letters Patent is hereby corrected as shown below:

Column 8, last line, claim 15, line 2, change "is comprises" to -- comprises --

Signed and Sealed this

*Eighth* Day of *July 1986*

[SEAL]

*Attest:*

DONALD J. QUIGG

*Attesting Officer*

*Commissioner of Patents and Trademarks*